US009999562B1

(12) United States Patent
Yeh

(10) Patent No.: US 9,999,562 B1
(45) Date of Patent: Jun. 19, 2018

(54) WALKER DEVICE

(71) Applicant: Yun-Hsiu Yeh, Hsinchu (TW)

(72) Inventor: Yun-Hsiu Yeh, Hsinchu (TW)

( * ) Notice: Subject to any disclaimer, the term of this patent is extended or adjusted under 35 U.S.C. 154(b) by 0 days. days.

(21) Appl. No.: 15/474,629

(22) Filed: Mar. 30, 2017

(51) Int. Cl.
*A61H 3/04* (2006.01)
*A61H 3/00* (2006.01)

(52) U.S. Cl.
CPC ..... *A61H 3/04* (2013.01); *A61H 2003/007* (2013.01); *A61H 2201/0192* (2013.01); *A61H 2201/1633* (2013.01); *A61H 2201/1635* (2013.01)

(58) Field of Classification Search
CPC ..... A61H 3/04; A61H 2201/1633; A61H 2201/1635; B62K 3/16; B62K 9/02
See application file for complete search history.

(56) References Cited

U.S. PATENT DOCUMENTS 3,180,678 A * 4/1965 McCabe ..... A61H 3/04 188/109
4,281,844 A * 8/1981 Jackman ..... B62K 9/02 280/263
4,770,410 A * 9/1988 Brown ..... A61H 3/04 135/67
4,861,051 A * 8/1989 Napper ..... A61H 3/04 135/67
5,320,122 A * 6/1994 Jacobson, II ..... A61H 3/04 135/66
5,732,964 A * 3/1998 Durham ..... A61H 3/04 135/67
6,634,660 B2 * 10/2003 Miller ..... A61H 3/04 135/67
2002/0130482 A1 * 9/2002 Jang ..... B62M 1/14 280/244
2005/0121873 A1 * 6/2005 Miller ..... A61H 3/04 280/87.021
2007/0182116 A1 * 8/2007 Davey ..... B62K 3/16 280/87.05
2016/0184167 A1 * 6/2016 Naucke ..... A61H 3/04 280/47.4

* cited by examiner

*Primary Examiner* — Hau V Phan
(74) *Attorney, Agent, or Firm* — Rabin & Berdo, P.C.

(57) ABSTRACT

A walker device includes: a main frame having opposite front and rear ends; a backrest rod unit; a hand-grip rod unit; and at least three rollers, wherein the backrest rod unit is mounted on the rear end of the main frame, the hand-grip rod unit is mounted on the front end of said main frame while each of the three rollers are mounted rotatably to a lower portion of the main frame via a leg unit. The backrest rod unit includes a seat-carrier rod projecting therefrom, a seat mounted on the seat-carrier rod and a slidable backrest provided with a safety belt.

12 Claims, 8 Drawing Sheets

WALKER DEVICE

BACKGROUND OF THE INVENTION

1. Field of the Invention

The present invention relates to a walker device, more particularly to a rehabilitation walker device which height can be adjusted according to the requirement of a patient being rehabilitated so as to support the patent effectively and to prevent the patient from falling off the walker device.

2. The Prior Arts

A walker device is one type of tool that a patient to stand and walk during the gradual recovery of health and strength after long illness or injury. It generally includes a main frame and a plurality of rollers attached to the main frame in order to support a patient on the main frame.

Since stroke survivors have some degree of paralysis, that is some muscles in legs or hands cannot move voluntarily and hence during the convalescence, they may easily fall down due to unable to balance their body weight. Therefore, a rehabilitation walker device is needed to assist and balance the gravity center. The presently existing rehabilitation walker device is not designed with fastening unit that can prevent accidental falling off the recovering patient.

Conventional walker device includes an enclosed member fixed on a main frame to encircle the patient therein. The structure does not permit easy access for the patient into the enclosed member and occupies a relatively large space, thereby transportation and storage thereof is not convenient.

SUMMARY OF THE INVENTION

A primary objective of the present invention is to provide a rehabilitation walker device which can support a stoke patent effectively and preventing the stroke patient from falling off the walker device when he or she tries to walk during the gradual convalescence period.

Another objective of the present invention is to provide a walker device, more particularly to a rehabilitation walker device which height can be adjusted according to the requirement of a patient being rehabilitated.

Yet another objective of the present invention is to provide a walker device, more particularly to a rehabilitation walker device which occupies little space so as to facilitate in transportation and storage thereof.

A walker device of the present invention accordingly includes: a main frame having opposite front and rear ends; a backrest rod unit; a hand-grip rod unit; and at least three rollers, wherein the backrest rod unit is mounted on the rear end of the main frame, the hand-grip rod unit is mounted on the front end of the main frame while each of the three rollers is mounted rotatably to a lower portion of the main frame via a leg unit, the backrest rod unit includes a seat-carrier rod projecting therefrom, a seat mounted on the seat-carrier rod and a slidable backrest provided with a safety belt.

In one embodiment of the present invention, the main frame has two pair of leg units, one pair of leg units is mounted at two opposite sides of the front end of the main frame adjacent to the hand-grip rod unit and another pair of leg units are mounted at two opposite sides of the rear end of the main frame adjacent to the backrest rod unit.

Preferably, in one embodiment of the present invention, the safety belt includes a left belt member and a right belt member attached respectively to left and right sides of the slidable backrest and two loop-and-hook fastener units attached respectively to free ends of the left and right belt members.

Since the left and right belt members can be wrapped around a patient's body and are fastened together by the loop-and-hook fastener units, the patient will be fully supported thereby and will not fall off the walker device of the present invention whenever he stands up or sit down. Thus the patient can practise walking without another person especially caring for him during walking or resting. In one embodiment of the present invention, though the conventional loop-and-hook fastener unit is employed, other fastening means can also be utilized so that the scope thereof should not be limited only thereto.

Preferably, soft and buffering layer can be wrapped around the hand-grip rod unit in order to provide comfortable handgrip feeling to the user. In the same manner the soft and buffering layer can also be wrapped around a seat carrier rod located between the hand-grip rod unit and the middle of the main frame so as to provide the same effect.

In order complement with the seat carrier rod of the backrest rod unit, a seat support rod is fixed on the middle part of the main frame in such a manner after a seat is mounted on the seat carrier rod, the seat carrier rod is propped up vertically by the seat support rod.

In addition, to configure with the height of a patient, the backrest rod unit, the seat support rod, the hand-grip rod unit and the leg units are provided with height adjustment means. To be more specific, the front and rear ends of the main frame are formed respectively with front and rear position fixing holes and a middle position fixing hole between the front and rear position fixing holes. The main frame further has three tubular sleeves extending downward in alignment with the front, middle and rear position fixing holes, each of three tubular sleeves is formed with a radial through hole such that the backrest rod unit, the seat support rod and the hand-grip rod unit are mounted in the front, middle and rear position fixing holes while the three leg units are inserted adjustably into the three tubular sleeves respectively.

Moreover, each of the backrest rod unit, the seat support rod and the hand-grip rod unit is formed with a vertical row of adjustment holes such that an adjustment bolt can be inserted into and fasten one of the adjustment holes in the vertical row in order to vary a height of each of the backrest rod unit, the seat support rod and the hand-grip rod unit.

In one embodiment of the present invention, the seat-carrier rod is mounted transversely on the seat carrier rod that is mounted vertically on a middle part of the main frame. The hand-grip rod unit consists of an upper hand rod and a lower hand rod connected telescopically with the upper hand rod, wherein the lower hand rod is formed with a vertical row of adjustment holes while the upper hand rod has a spring-loaded protrusion projecting radially and outwardly therefrom and extending into one of the adjustment holes in order to vary a height of the hand-grip rod unit. Similarly, each leg unit consists of an upper leg rod and a lower leg rod connected telescopically with the upper leg rod, wherein the lower leg rod is formed with a vertical row of adjustment holes while the upper leg rod has a spring-loaded protrusion projecting radially and outwardly therefrom and extending into one of the adjustment holes in order to vary a height of each leg unit. In other words, the height of the walker device of the present invention can be adjusted according to the requirement of the patient.

For assembly, the rollers are mounted rotatably to the leg units via screws and after which, the leg units are mounted to lower portion of the main frame. The height of each of the hand-grip rod unit, the backrest rod and the seat support rod is adjusted according to the patient's height and the latter are mounted on the main frame.

When a patient recovering from long illness tries to walk, he is helped to be seat on the seat and is fastened by the left and right belt members through the loop-and-hook fastener units. After the patient gripping the hand-grip rod unit of the main frame, he can safely start walking without the fear of being accidentally falling off the main frame due to unable to balance one's weight since the safety belt being wrapped around the patient's body. In other words, the patient is prevented from suffering other injuries during the convalescence.

In one embodiment of the present invention, since the leg units are mounted foldable relative to the main frame and movable between used position, in which the leg unit are stretched out to support the main frame vertically and a storage position, in which the leg units are folded onto the main frame and hence occupying relatively small space to facilitate storage and transportation.

Note that the number of leg units can be varying according to the supporting requirement of the patient. For instance, more legs are needed if the patient is bulky and heavy. In one embodiment of the present invention, the main frame has two pairs of leg units, one pair of leg units is mounted at two opposite sides of the front end of the main frame adjacent to the hand-grip rod unit and another pair of leg units is mounted at two opposite sides of the rear end of the main frame adjacent to the backrest rod unit.

Alternately, if the patient is relatively thin, the number of the leg units in the abovementioned walker device can be reduced if required. In one embodiment of the present invention, the front end of the main frame is provided with a connection hole for receiving one leg unit adjacent the hand-grip rod unit while remaining two leg units are mounted to the rear end of the main frame adjacent to the backrest rod unit.

BRIEF DESCRIPTION OF THE DRAWINGS

The present invention will he apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve explain the principles of the invention.

Figure 1A:
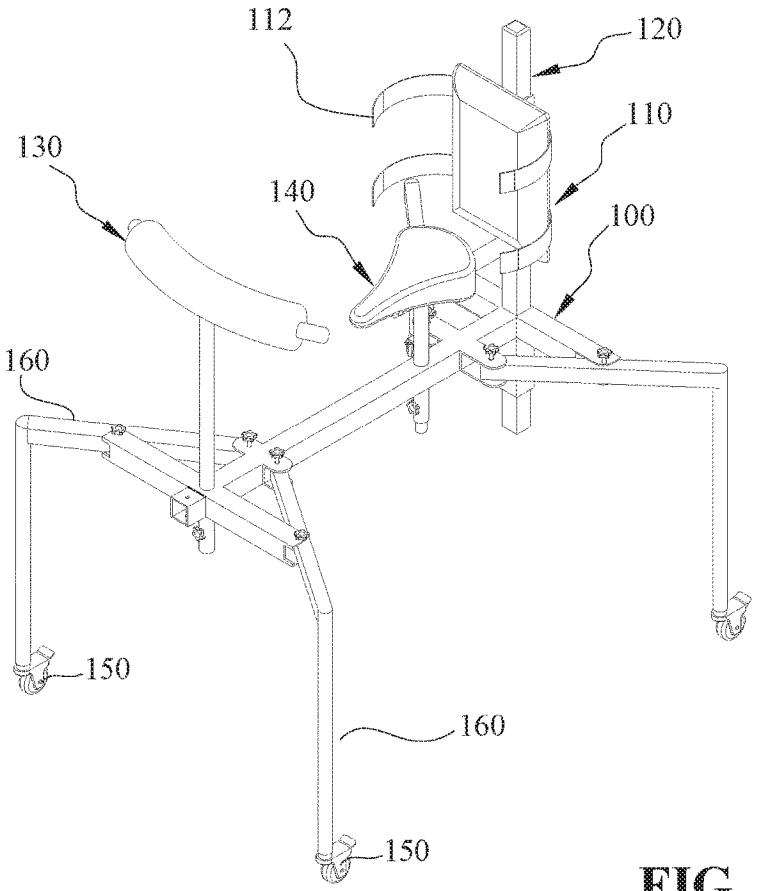
FIG. 1A is a perspective view illustrating walker device according to a first embodiment of the of the present invention.
Figure 1B:
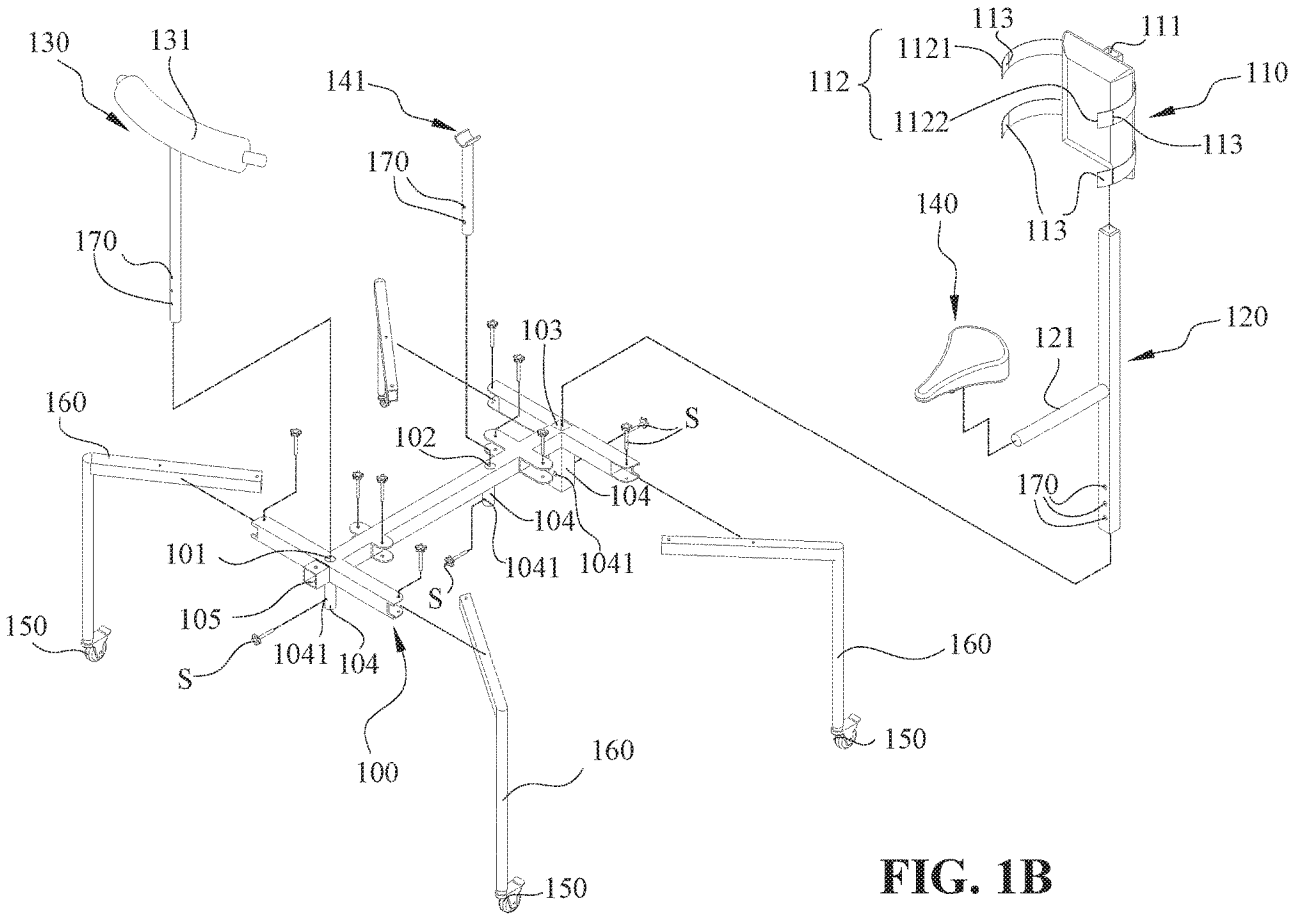
FIG. 1B is an exploded view illustrating the walk device according to the first embodiment of the of the present invention.

Referring to FIGS. 1A and 1B, wherein, FIG. 1A is a perspective view illustrating a rehabilitation walker device according to a first embodiment of the present invention; and FIG. 1B is an exploded view illustrating the rehabilitation walker device of according to the first embodiment of the f the present invention. The rehabilitation walker device of the present invention includes: a main frame 100 having opposite front and rear ends; a backrest 110; a backrest rod unit 120; a hand-grip rod unit 130; and a plurality of rollers 150, the detailed description will be given in the following paragraphs.

Figure 2:
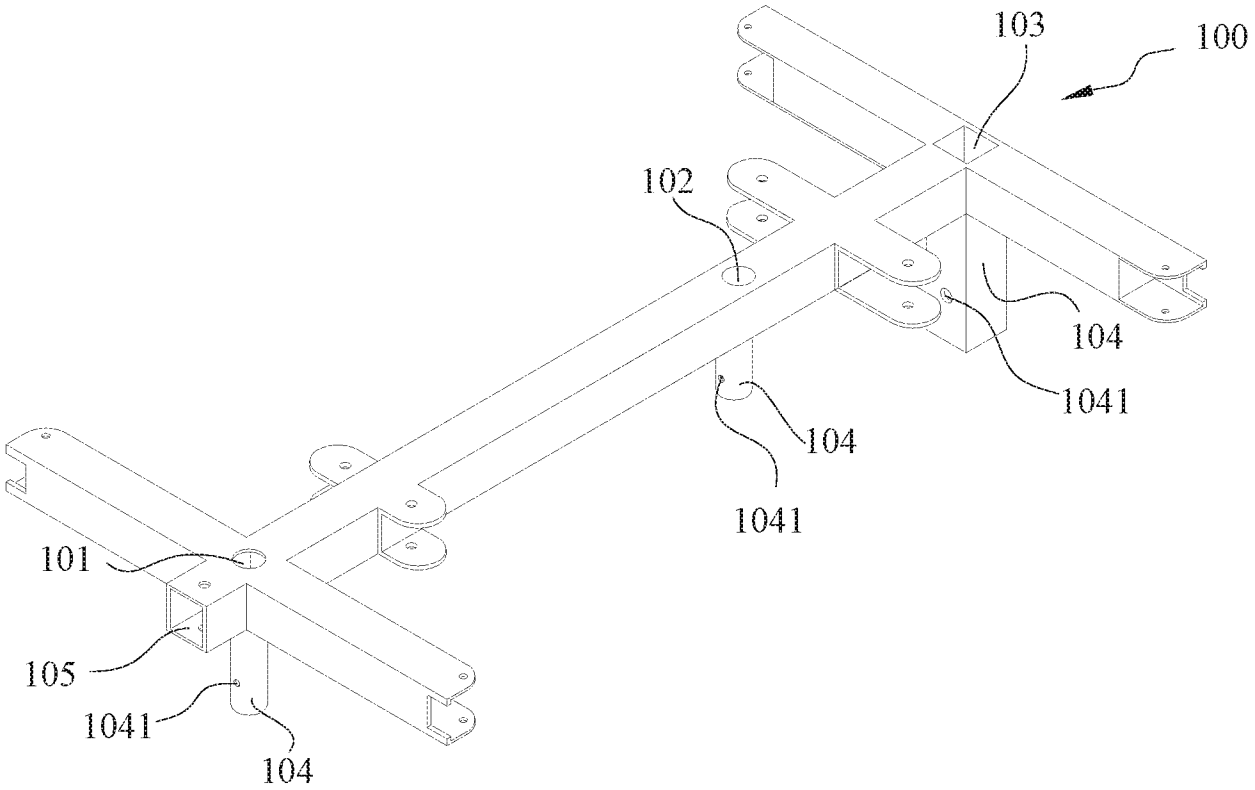
FIG. 2 is a perspective view illustrating the walker device according to the first embodiment of the of the present invention.

As best shown in FIG. 2, the front and rear ends of the main frame 100 are formed respectively with front and rear position fixing holes 101, 103 and a middle position fixing hole 102 between the front and rear position fixing holes 101. The main frame 100 further has three tubular sleeves 104 extending downward in alignment with the front, middle and rear position fixing holes 101, 102, 103. Each of three tubular sleeves 104 is formed with a radial through hole 1041 such that each radial through hole 1041 is transverse to an axis of the tubular sleeve 104. The hand-grip rod unit 130 is mounted in the front position fixing hole 101 of the main frame 100, the backrest rod unit 120 is mounted in the rear position fixing hole 103 while a seat support rod 141 is mounted in the middle position fixing hole 102 of the main frame 100.

To be more specific, the rear position fixing hole 103 is rectangular in shape such that the backrest rod unit 120 is also rectangular cross section then only it can be inserted adjustably and fittingly in the rear position fixing hole 103, the configuration of the rear position fixing hole 103 should not be limited only thereto, it should include many other configurations so long the backrest rod unit 120 can be mounted therein.

In one embodiment of the present invention, the main frame 100 has two pair of leg units 160, one pair of leg units is mounted at two opposite sides of the front end of the main frame 100 via fastener screw unit S adjacent to the hand-grip rod unit 130 and another pair of leg units 160 is mounted at two opposite sides of the rear end of the main frame 100 via fastener screw unit S adjacent to the backrest rod unit 120. Each set of fastener screw unit S includes a threaded bolt (an adjustment bolt) and an internally threaded nut.

Preferably, soft and buffering layer 131 can he wrapped around the hand-grip rod unit 130 in order to provide comfortable handgrip feeling to the user. Sponge material or other soft and elastic materials are used for fabrication the buffering layer 131. The material should not be limited to the disclosed ones, many other can be utilized so as they may provide the same effect.

The backrest rod unit 120 includes a seat-carrier rod 121 projecting therefrom; a seat 140 mounted on the seat-carrier rod 121 and a slidable backrest 110. Preferably, the slidable backrest 110 is provided with a sliding sleeve ring 111 that can be sleeved on the backrest rod to permit its height adjustment and further with a safety belt 112. The safety belt 112 includes a left belt member 1121 and a right belt member 1122 attached respectively to left and right sides of the slidable backrest 110 and two loop-and-hook fastener units 113 attached respectively to free ends of the left and right belt members 1121, 1122.

Note the fastener units 113 should not be limited only to the disclosed ones, many other configurations that may provide the same effect should be included.

In the mounting of the seat 140 over the seat-carrier rod 121, a seat support rod 141 is first of all mounted adjustably in the middle position fixing hole 102 and later supports the seat-carrier rod 121 vertically from a lower elevation such that rigidity of the main frame 100 is enhanced.

To complement with the varied height of each patient, a height adjustment device is utilized for the backrest rod unit 120, the seat support rod 141 and the hand-grip rod unit 130. Each of the backrest rod unit 120, the seat support rod 141 and the hand-grip rod unit 130 is formed with a vertical row of adjustment holes 170 such that an adjustment bolt can be inserted into and fasten one of the adjustment holes 170 in the vertical row in order to vary a height of each of the backrest rod unit 120, the seat carrier rod 141 and the hand-grip rod unit 130. Note that each adjustment hole 170 extends transverse to the axes of the backrest rod unit 120, the seat support rod 141 and the hand-grip rod unit 130.

Once the threaded bolts of fastener screw unit S extend through the radial through hole 1041 in the tubular sleeve 104, the adjustment holes 170 in the backrest rod unit 120, the seat support rod 141 and the hand-grip rod unit 130, the internally threaded nuts (not visible) can be mounted threadedly on the bolts, the height of all these elements are altered.

Note that the height adjustment of the backrest rod unit 120 simultaneously results in the height adjustment of the seat 140, since the seat 140 is fixed on the seat carrier rod 121 integrally formed with the backrest rod (not separately numbered).

Figure 3A:
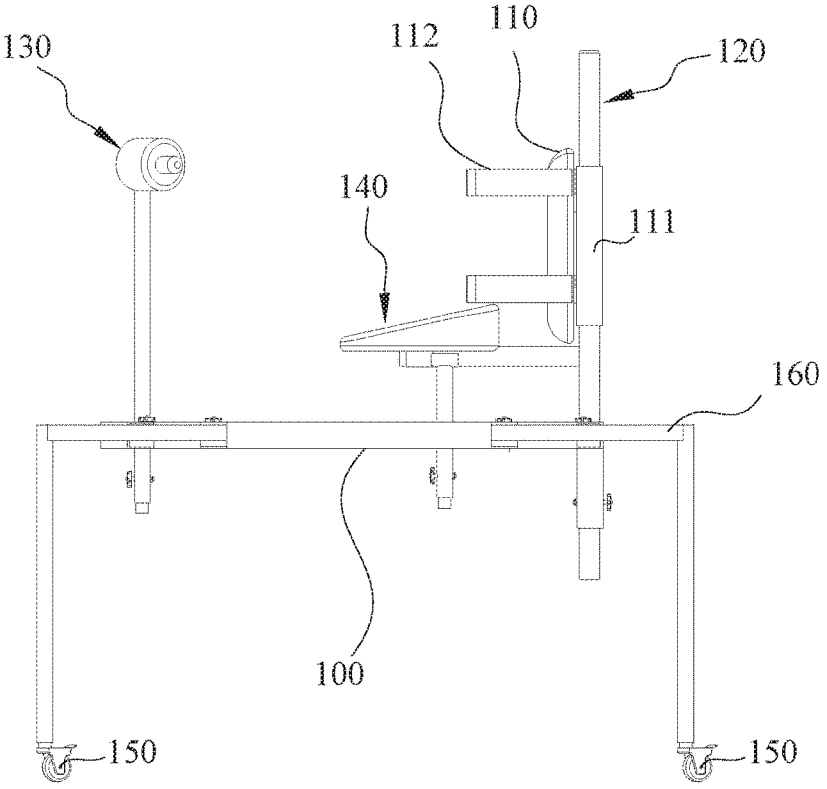
FIG. 3A is a lateral side view illustrating the walker device according to the first embodiment of the of the present invention.
Figure 3B:
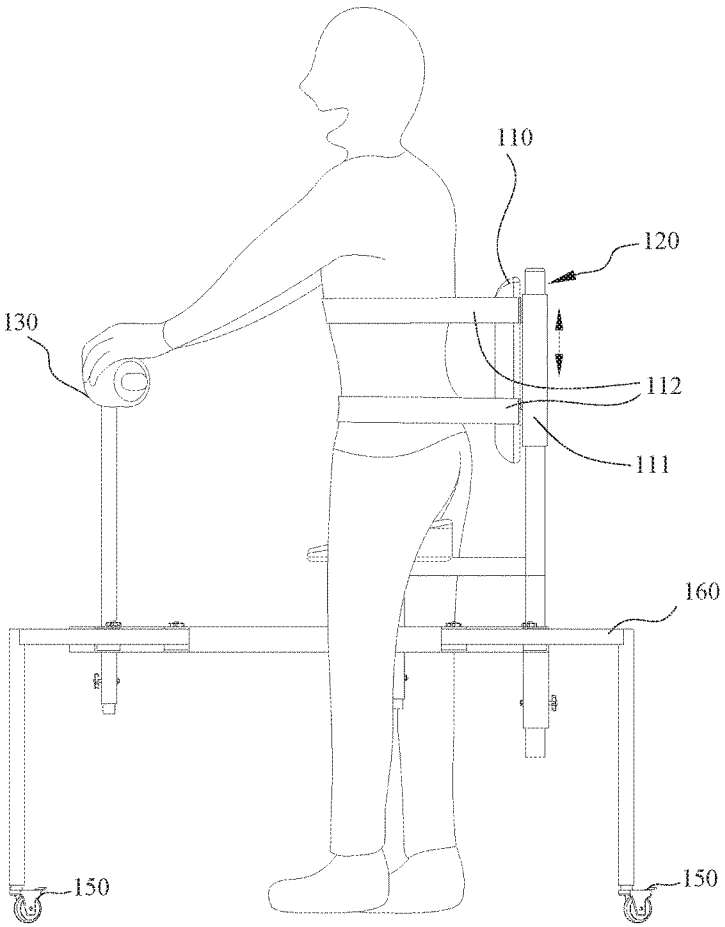
FIG. 3B is a lateral side view illustrating the walker device according to the first embodiment of the of the present invention in a real application.

Referring to FIGS. 3A and 3B, wherein, FIG. 3A is a lateral side view illustrating the walker device according to the first embodiment of the present invention; and FIG. 3B is a lateral side view illustrating the walker device according to the first embodiment of the of the present invention in a real application. For real application, the thighs of the patient recovering from long illness is to straddle across the seat 140, after which the left and right belt members 1121, 1122 in the safety belt 112 of the backrest 111 should go around the patient's chest and the loop-and-hook fastener unit 113 are fastened relative to each other, thereby securing the patient within the safety belt 112. The patient encouraged to walk slowly without the fear of falling down from the walker device of the present invention.

Note that the patient is prevented from falling down from the walker device even in the event of standing up from the seat 140, because the safety belt 113 does not fall away from the patient since the left and right belt members of the safety belt 113 are attached securely to two left and right sides of the slidable backrest 110.

Figure 4A:
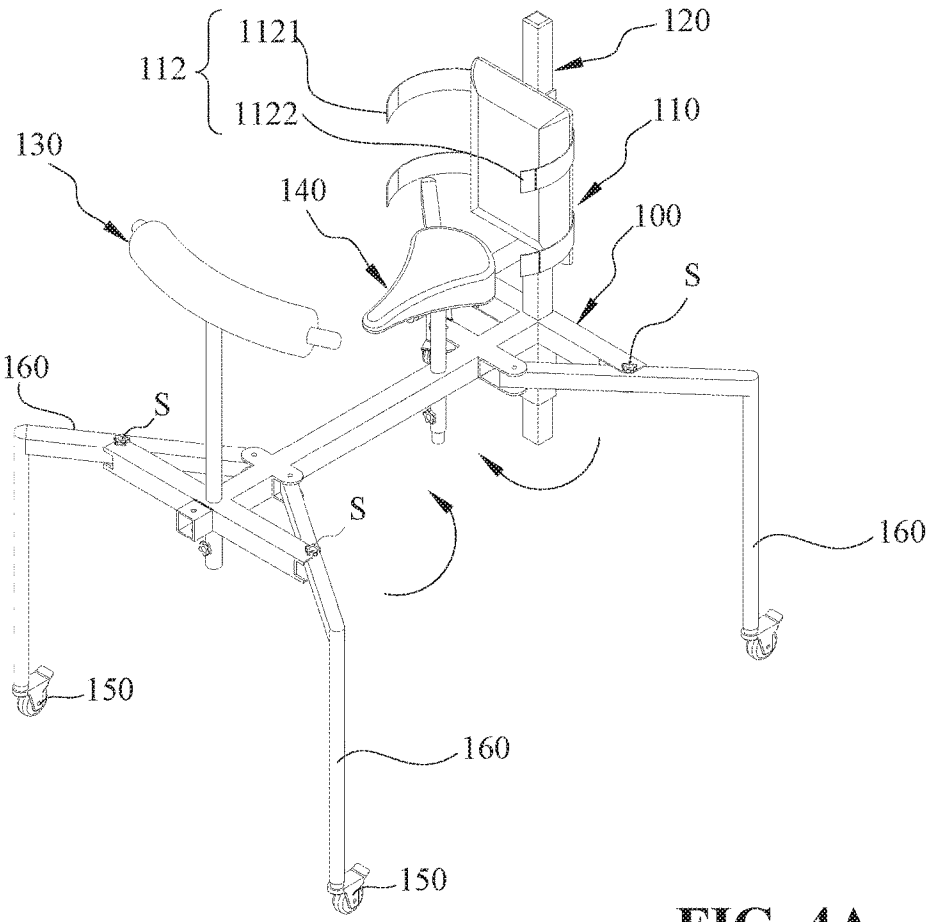
FIGS. 4A and 4B are perspective view of the walker device according to a second embodiment of the of the present invention in unfolded and storage positions.
Figure 4B:
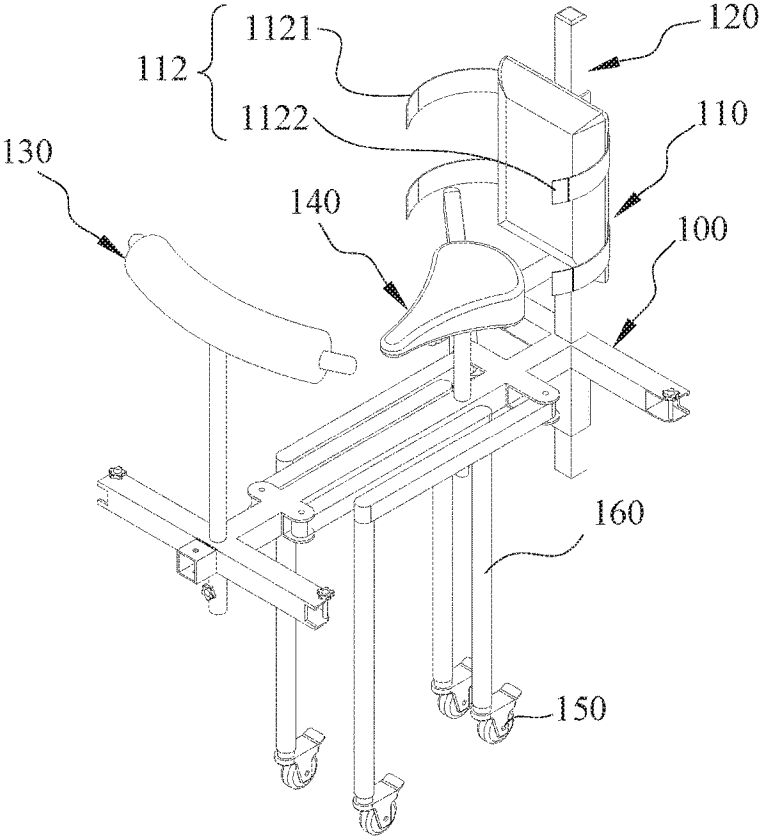

FIGS. 4A and 4B are perspective view of the walker device according to a second embodiment of the present invention in unfolded and storage positions. The second embodiment is similar to the first embodiment, except in that the main frame 100 has two pair of leg units 160, one pair of leg units is connected foldably at two opposite sides of the front end of the main frame 100 adjacent to the hand-grip rod unit 130 and another pair of leg units is connected foldably at two opposite sides of the rear end of the main frame 100 adjacent to the backrest rod unit 120. For storage or transportation, the fastener screw units S are removed from the main frame 100 to permit the front and rear pairs of legs 160 folded onto the main frame 100, as best shown in FIG. 4B. Note that the walker device of the present invention occupies a relatively small storage space.

Figure 5:
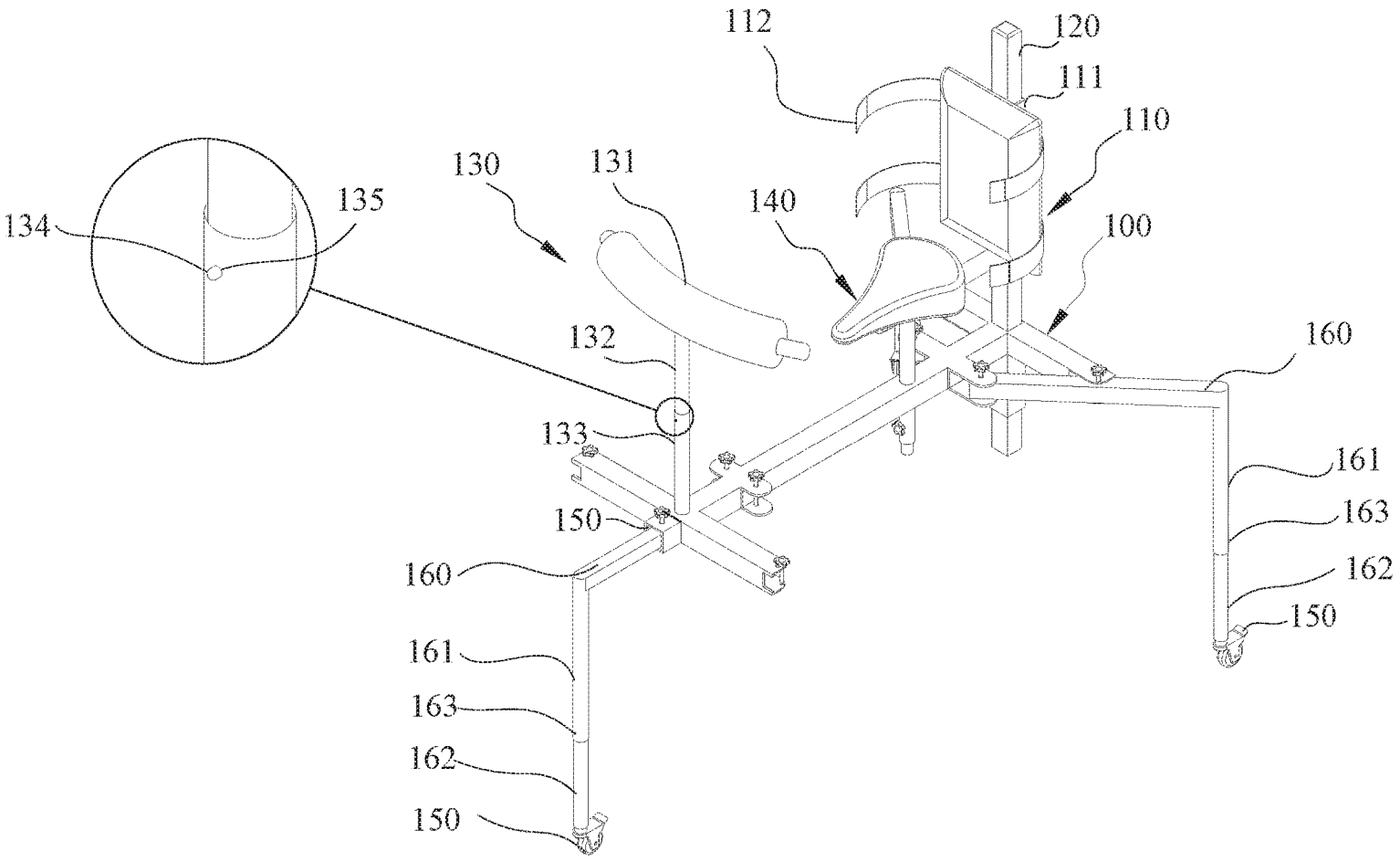
FIG. 5 is a perspective view illustrating the walker device according to a third embodiment of the present invention.

FIG. 5 is a perspective view illustrating the walker device according to a third embodiment of the present invention. The third embodiment has the structure similar to the first embodiment, except in that the front end of the main frame 100 is provided with a connection hole 105. In this embodiment, the hand-grip rod unit 130 consists of an upper hand rod 132 and a lower hand rod 133 connected telescopically with the upper hand rod 132.

To be more specific, the lower hand rod 133 is formed with a vertical row of adjustment holes 135 while the upper hand rod 132 has a spring-loaded protrusion 134 projecting radially and outwardly therefrom and extending into one of the adjustment holes 135 in order to vary a height of the hand-grip rod unit 130. Preferably, each leg unit 160 consists of an upper leg rod 161 and a lower leg rod 162 connected telescopically with the upper leg rod 151, wherein the lower leg rod 162 is formed with a vertical row of adjustment holes 170 while the upper leg rod 161 has a spring-loaded protrusion 163 projecting radially and outwardly therefrom and extending into one of the adjustment holes 170 in order to vary a height of each leg unit 160.

An important aspect to note is that the number of leg units 160 can be varied according to the weight of the patient being rehabilitated. For instance, if the walker device of the present invention is intended for a thin patient, only three leg units 160 are required such that the connection hole 105 in the front end of the main frame 100 is fit for receiving one leg unit 160 adjacent the hand-grip rod unit 130 while remaining two leg units 160 are mounted to the rear end of the main frame 100 adjacent to the backrest rod unit 120. Of course, fastener screw units S are utilized for mounting of the leg units 160 to the main frame 100.

The advantages provided by the walker device of the present invention are as follows: since the patient recovering from long illness is prevented from accidentally falling off the main frame 100 due to lack of physical power, the recovery process is quicken. In addition, the leg units can be folded onto the main frame when not in use, the storage space thereof can be economized and the number of leg units as well as the rollers can be varied according the requirement of the patient's body weight.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A walker device, comprising:

a main frame having opposite front and rear ends formed respectively with front and rear position fixing holes and a middle position fixing hole between the front and rear position fixing holes, and having three tubular sleeves extending downward in alignment with the front, middle and rear position fixing holes;

a backrest rod unit mounted on the rear end of the main frame and having a seat-carrier rod projecting therefrom, a seat mounted on the seat-carrier rod and a slidable backrest provided with a safety belt;

a hand-grip rod unit mounted on the front end of the main frame; and at least three rollers, each roller of the at least three rollers mounted rotatably to a lower portion of the main frame via a leg unit, wherein each of three tubular sleeves of the main frame is formed with a radial through hole such that the backrest rod unit, a seat support rod and a hand-grip rod unit are mounted in the front, middle and rear position fixing holes while the three leg units are inserted adjustably into the three tubular sleeves respectively.

2. The walker device according to claim 1, wherein the safety belt includes a left belt member and a right belt member attached respectively to left and right sides of the slidable backrest and a loop-and-hook fastener unit attached to free ends of the left and right belt members.

3. The walker device according to claim 1, wherein each of the backrest rod unit, the seat support rod and the hand-grip rod unit is formed with a vertical row of adjustment holes such that an adjustment bolt can be inserted into and fasten one of the adjustment holes in the vertical row to vary height of each of the backrest rod unit, the seat support rod and the hand-grip rod unit.

4. The walker device according to claim 1, wherein the seat-carrier rod is mounted transversely on the seat carrier rod that is mounted vertically on a middle part of the main frame.

5. The walker device according to claim 1, wherein the hand-grip rod unit consists of an upper hand rod and a lower hand rod connected telescopically with the upper hand rod, wherein the lower hand rod is formed with a vertical row of adjustment holes while the upper hand rod has a spring-loaded protrusion projecting radially and outwardly therefrom and extending into one of the adjustment holes in order to vary height of the hand-grip rod unit.

6. The walker device according to claim 1, wherein each leg unit consists of an upper leg rod and a lower leg rod connected telescopically with the upper leg rod, wherein the lower leg rod is formed with a vertical row of adjustment holes while the upper leg rod has a spring-loaded protrusion projecting radially and outwardly therefrom and extending into one of the adjustment holes in order to vary a height of each leg unit.

7. The walker device according to claim 1, wherein the three leg units are mounted foldably to the main frame and movable between a used position, where the leg units are stretched relative to the main frame and a storage position, where the leg units are folded onto the main frame.

8. The walker device according to claim 7, wherein the main frame has two pair of leg units, one pair of leg units at two opposite sides of the front end of the main frame adjacent to the hand-grip rod unit and another pair of leg units at two opposite sides of the rear end of the main frame adjacent to the backrest rod unit.

9. The walker device according to claim 1, wherein the front end of the main frame is provided with a connection hole for receiving one leg unit adjacent the hand-grip rod unit while remaining two leg units are mounted to the rear end of the main frame adjacent to the backrest rod unit.

10. A walker device, comprising:

a main frame having opposite front and rear;

a backrest rod unit mounted on the rear end of the main frame and having a seat-carrier rod projecting therefrom, a seat mounted on the seat-carrier rod and a slidable backrest provided with a safety belt;

a hand-grip rod unit mounted on the front end of the main frame; and at least three rollers, each roller of the at least three rollers mounted rotatably to a lower portion of the main frame via a leg unit, wherein each leg unit consists of an upper leg rod and a lower leg rod connected telescopically with the upper leg rod, wherein the lower leg rod is formed with a vertical row of adjustment holes while the upper leg rod has a spring-loaded protrusion projecting radially and outwardly therefrom and extending into one of the adjustment holes in order to vary a height of each leg unit.

11. A walker device, comprising:

a main frame having opposite front and rear ends, the main frame having three leg units;

a backrest rod unit mounted on the rear end of the main frame and having a seat-carrier rod projecting therefrom, a seat mounted on the seat-carrier rod and a slidable backrest provided with a safety belt;

a hand-grip rod unit mounted on the front end of the main frame; and at least three rollers, each roller of the at least three rollers mounted rotatably to a lower portion of the main frame via one of the leg units, wherein the three leg units are mounted foldably to the main frame and movable between a used position, where the leg units are stretched relative to the main frame and a storage position, where the leg units are folded onto the main frame.

12. The walker device according to claim 11, wherein the main frame has two pair of leg units, one pair of leg units at two opposite sides of the front end of the main frame adjacent to the hand-grip rod unit and another pair of leg units at two opposite sides of the rear end of the main frame adjacent to the backrest rod unit.

* * * * *